US006668843B2

(12) United States Patent
Chen

(10) Patent No.: US 6,668,843 B2
(45) Date of Patent: Dec. 30, 2003

(54) METHOD FOR MANUFACTURING A WET TOWEL AND THE APPARATUS THEREOF

(75) Inventor: Chien-Jung Chen, Kaohsiung (TW)

(73) Assignee: Yen Sun Technology Corp., Kaohsiung Hsien (TW)

( * ) Notice: Subject to any disclaimer, the term of this patent is extended or adjusted under 35 U.S.C. 154(b) by 253 days.

(21) Appl. No.: 09/835,555

(22) Filed: Apr. 17, 2001

(65) Prior Publication Data

US 2002/0148491 A1 Oct. 17, 2002

(51) Int. Cl.[7] ..... B08B 3/04; A47K 10/26

(52) U.S. Cl. ..... 134/122 R; 68/13 R; 68/205 R

(58) Field of Search ..... 68/200, 205 R, 68/13 R; 134/122 R; 118/325; 221/71, 70

(56) References Cited

U.S. PATENT DOCUMENTS 5,829,278 A * 11/1998 Koo ..... 68/205 R
6,343,491 B1 * 2/2002 Jung ..... 68/13 R
6,431,111 B1 * 8/2002 Zhang ..... 118/43
6,601,730 B2 * 8/2003 Chen ..... 221/71

FOREIGN PATENT DOCUMENTS

| | | | | |
|---|---|---|---|---|
| EP | 1078593 A1 | * | 2/2001 | ..... A47K/10/26 |
| JP | 2000139756 A | * | 5/2000 | ..... A47K/7/00 |
| JP | 2000139757 A | * | 5/2000 | ..... A47K/7/00 |
| JP | 2000287867 A | * | 10/2000 | ..... A47K/7/00 |
| JP | 2001046265 A | * | 2/2001 | ..... A47K/7/00 |
| JP | 2001057947 A | * | 3/2001 | ..... A47K/7/00 |
| TW | 356819 | | 10/1997 | |

* cited by examiner

*Primary Examiner*—Alexander Markoff
(74) *Attorney, Agent, or Firm*—Birch, Stewart, Kolasch & Birch, LLP

(57) ABSTRACT

A towel material for forming a wet towel is made in a drying, compressing or evacuating manner. The towel material may form a compact unit having a strip shape, block shape, or particle shape. The towel material unit stored in the manufacturing apparatus. After the user emits the using signal, the towel material unit falls according to the signal of the manufacturing amount, and is wet or immersed, so that the towel material unit is expanded into a wet towel.

11 Claims, 4 Drawing Sheets

METHOD FOR MANUFACTURING A WET TOWEL AND THE APPARATUS THEREOF

BACKGROUND OF THE INVENTION

1. Field of the Invention

The present invention relates to a method for manufacturing a wet towel and the apparatus thereof, wherein the manufacturing apparatus of the wet towel is simpler, and the wet towel can be made conveniently.

2. Description of the Related Art

The closest prior art of which the applicant is aware is disclosed in the Taiwanese Patent Publication No. 356819, entitled by "Cutting Structure Improvement of a Wet Paper Towel Supplying Machine", wherein it discloses a cutting structure of a wet paper towel. A U-shaped frame is mounted in a machine station for placing a paper towel material wheel, so that the paper towel material is transferred by the driving wheel to enter the guide plate set, the mobile cutting blade shaft, and the lower cutting blade set to be cut into a predetermined length to proceed the twisting work. The two ends of the main shaft of the mobile cutting blade shaft are respectively secured with a push cam and a press cam. The push cam is protruded with a push section, and the press cam is recessed with an operation section. The press plate of the guide plate set and the lower cutting blade set are provided with an elasticity by elastic members. Thus, the lower cutting blade set is initially pressed to the inner side by the press cam. When the paper towel material is to be cut, the press cam is rotated to the operation section, so that the lower cutting blade set moves back by the elastic force of the elastic member, to mate with the upper cutting blade of the mobile cutting blade set, while the press plate is pressed by the push plate of the push cam whereby the lower end of the press plate is closely rested on the guide plate to clamp the paper towel material, so that the upper and lower cutting blades may cut the paper towel material conveniently.

In the conventional manufacturing method of a wet towel, an entire roll of paper towel material is stored, then cut by the upper and lower cutting blades, and is then processed by wetting and twisting works, so that the dry paper towel is formed into a wet paper towel to be output. In general, the conventional manufacturing method of the wet towel has a complicated construction, and the cutting blades and the twisting equipment cannot endure use during a long period of time, so that they are easily worn out. In addition, the entire roll of paper towel material is stored, so that the diameter of the paper towel material is enlarged to satisfy the requirement of use of a large amount. Thus, the volume of the paper towel machine becomes very large relatively.

SUMMARY OF THE INVENTION

The primary objective of the present invention is to provide a manufacturing method of a wet towel, wherein a new manufacturing manner is used to make the wet towel.

A secondary objective of the present invention is to provide a manufacturing apparatus of a wet towel. The wet towel is made by a new manufacturing manner, so that the manufacturing apparatus of the wet towel has a simple structure, can be used during a long period of time, and is not easily worn out.

A further objective of the present invention is to provide a towel material of a wet towel, wherein the towel material is formed with a compact unit, so that the towel material unit may have a smaller volume and is easily stored.

The present invention is to make a towel material for forming a wet towel, that is made by a drying, compressing or evacuating manner. The towel material may form a compact unit having a strip shape, block shape, or particle shape. The towel material unit is stored in the manufacturing apparatus. After the user emits the using signal, the towel material unit falls according to the signal of the manufacturing amount, and is wet or immersed, so that the towel material unit is expanded into a wet towel.

Further benefits and advantages of the present invention will become apparent after a careful reading of the detailed description with appropriate reference to the accompanying drawings.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENTS

Figure 1:
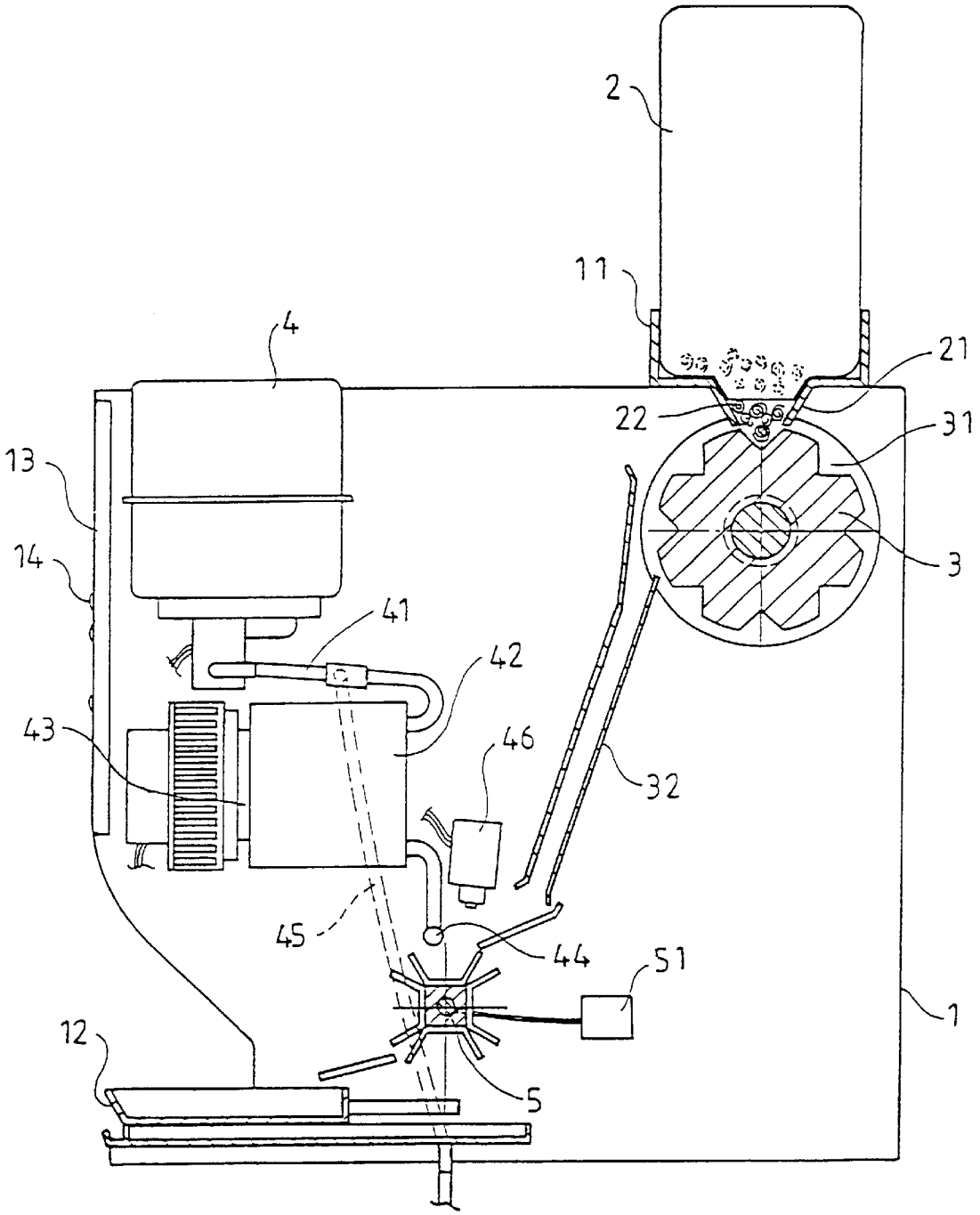
FIG. 1 is a schematic view of an apparatus for manufacturing a wet towel in accordance with a first embodiment of the present invention.

Referring to the drawings and initially to FIG. 1, an apparatus for manufacturing a wet towel in accordance with a first embodiment of the present invention comprises a housing 1 containing a storage box 2, a control wheel member 3, a liquid supply member 4, and an output member 5 therein. The housing 1 may be placed or suspended at a proper position, and has a panel 13, and a control member 14, so that the manufacturing apparatus of the wet towel may be manipulated.

The storage box 2 may be a replaceable box, and may be placed in the chamber 11 of the housing 1. The chamber 11 may be at the inner side or outer side of the housing 1. The storage box 2 may store a large amount of towel material units 22 that may be derived from cotton starch, wood starch etc. made of a natural fiber or synthetic fiber, and may be made to have a smaller compact volume by a drying, compressing or evacuating manner. The towel material may be formed to have a strip shape, block shape, or particle shape, and the towel material units 22 are supplied to the control wheel member 3 through an outlet 21 located above the control wheel member 3.

The control wheel member 3 may be a wheel that can be driven. The user may send a using signal, whereby the control wheel member 3 can be driven to rotate by a power member, such as a motor, so that the distribution slots 31 of the control wheel member 3 may bear the falling towel material units 22. In the preferred embodiment, the housing 1 is provided with push buttons that may be used to select the number of the wet towel to be used, and to select the hot wet towel or the cold wet towel. Thus, when the user pushes the control member 14 to emit the using signal, the control wheel member 3 may supply a predetermined amount of towel material units 22 through a guide conduit 32 to the output member 5.

The liquid supply member 4 may be mounted at a proper position of the housing 1, for storing a liquid with a normal temperature. When the user sends the signal of using the hot wet towel or cold wet towel, the liquid may be guided through the guide pipe 41 to the heating member 42 or the cooling member 43, wherein the heating member 42 may be a conventional electrical heater, and the cooling member 43 may be a conventional cooling chip or refrigerant compressor. Thus, the liquid may be formed into the hot water or cold water, and may be ejected through a plurality of nozzles 44, so as to wet the towel material units 22 placed in the output member 5, so that the towel material units 22 are expanded to form the hot wet towel or cold wet towel. In addition, the liquid supply member 4 may be provided with a liquid drain pipe 45. When the liquid stored in the liquid supply member 4 needs to be cleaned or drained, the liquid may directly drained outward through the liquid drain pipe 45. In addition, during the wetting process of the towel material units 22, the auxiliary nozzle 46 may eject a fragrant agent, so that the hot wet towel or cold wet towel contains fragrance.

The output member 5 is located at the terminal of the guide conduit 32, to mate with the liquid ejecting position of the nozzle 44, and may be formed with a plurality of receiving slots that are rotated like a wheel. The operation of the output member 5 may be controlled by a program or a timer. After the towel material units 22 fall and are wet, the output member 5 may be driven by a power member to rotate through a proper angle, so that the hot wet towel or cold wet towel may fall into an article outlet 12 mounted on the housing 1 to be used. The amount of rotation of the output member 5 may be calculated by a sensor 51.

Figure 2:
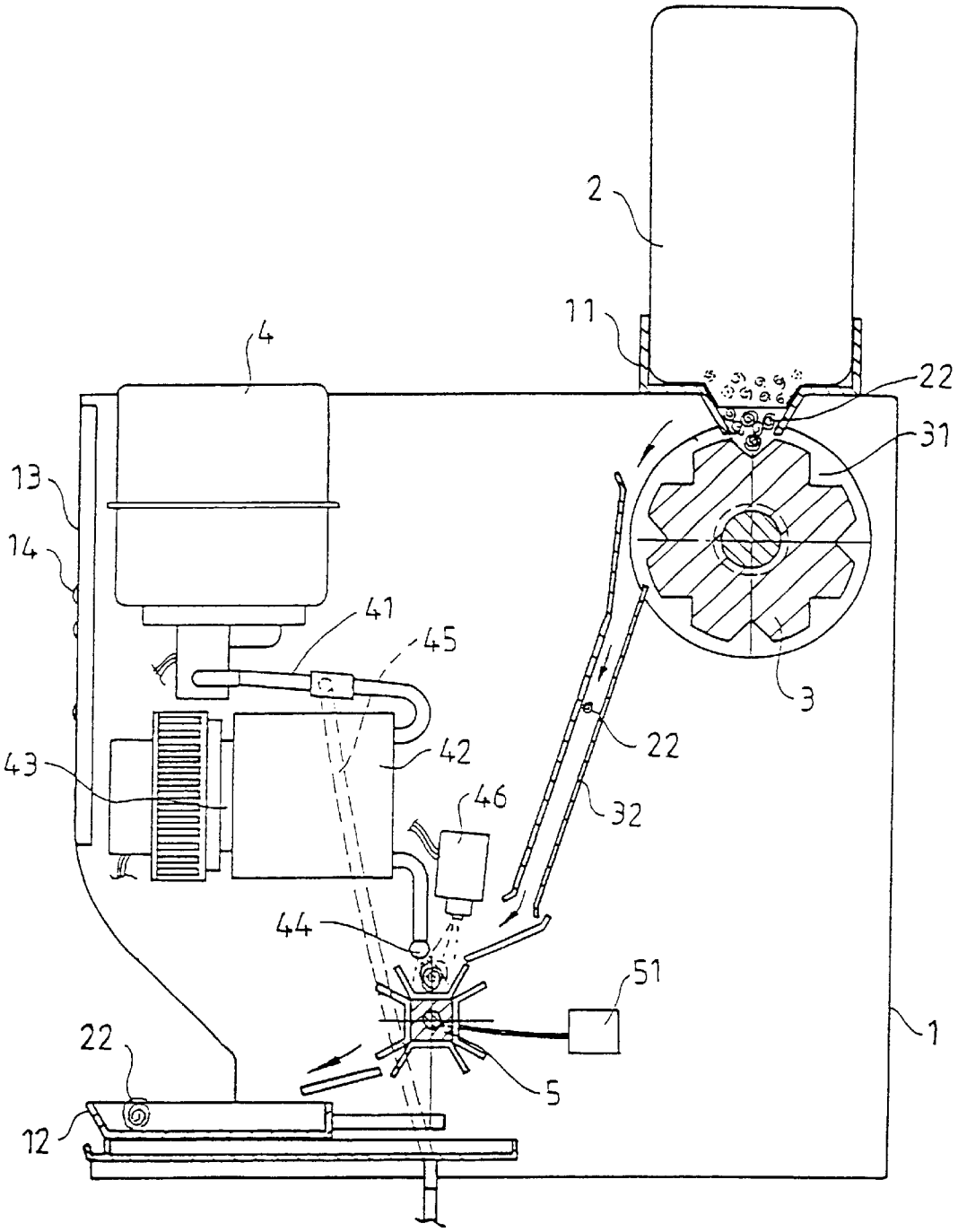
FIG. 2 is an operational view of the apparatus for manufacturing a wet towel as shown in FIG. 1 in use.

Referring to FIG. 2, the storage box 2 is placed in the chamber 11 of the housing 1, so that the towel material units 22 placed in the storage box 2 fall into the distribution slots 31 of the control wheel member 3 through the outlet 21. The user may push the control member 14 to emit a using signal, whereby the control wheel member 3 may be rotated through a proper angle, so that a predetermined amount of towel material units 22 may fall through the guide conduit 32 to the output member 5. At this time, the liquid supply member 4 outputs the liquid which is controlled by the using signal emitted from the user to flow through the operated heating member 42 or cooling member 43, so that the liquid becomes hot water or cold water, to wet the towel material units 22 placed in the output member 5. After the towel material unit 22 absorbs the liquid, the towel material unit 22 may be expanded into a wet towel during a short period of time (about three seconds), which may driven by the output member 5 to fall into the article outlet 12 for use.

Figure 3:
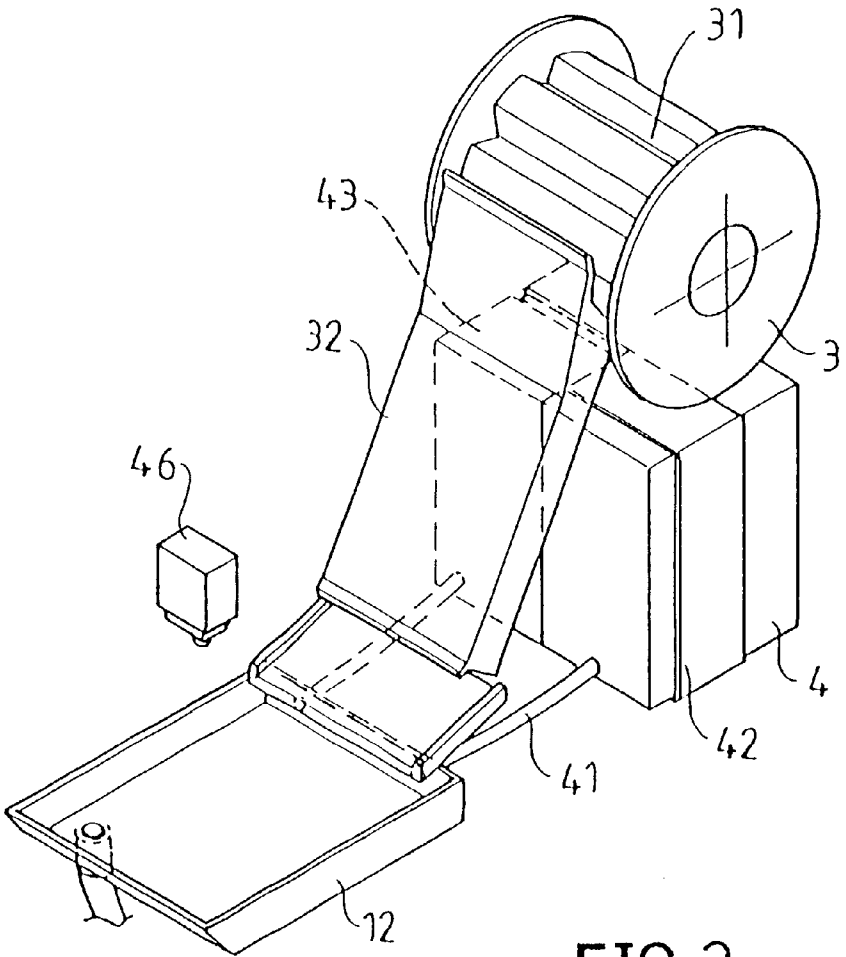
FIG. 3 is a locally perspective view of an apparatus for manufacturing a wet towel in accordance with a second embodiment of the present invention.
Figure 4:
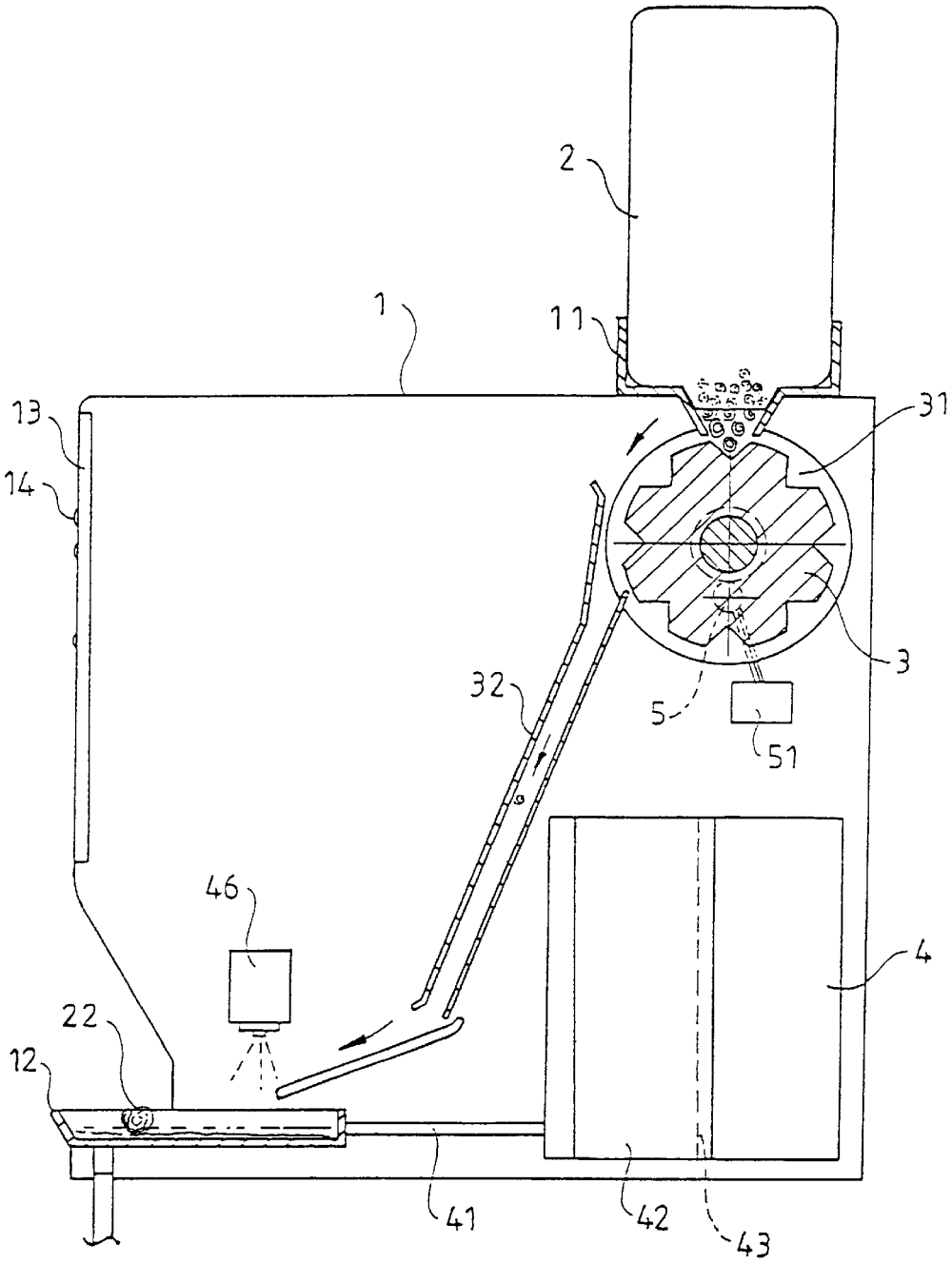
FIG. 4 is a schematic view of the apparatus for manufacturing a wet towel in accordance with the second embodiment of the present invention.

Referring to FIGS. 3 and 4, in accordance with a second embodiment of the present invention, the liquid of the liquid supply member 4 directly flows through the heating member 42 or cooling member 43, and the hot water or cold water is guided through the guide pipe 41 into a storage tank 47 which may be the article output 12 of the housing 1. Thus, by rotation of the control wheel member 3, the towel material units 22 placed in the distribution slots 31 of the control wheel member 3 may directly fall into the storage tank 47, so that the towel material units 22 may absorb the hot water or cold water, thereby forming the hot wet towel or cold wet towel to be used directly. The storage tank 47 may be provided with the liquid drain pipe 45 for draining excessive liquid.

The wet towel manufacturing method, the wet towel manufacturing apparatus, and the towel material unit in accordance with the present invention are quite different from the conventional ones. In accordance with the present invention, the towel material units may be derived from cotton starch, wood starch etc. made of a natural fiber or synthetic fiber, and may be made to have a smaller compact volume by a drying, compressing or evacuating manner. The towel material units may be formed to have a strip shape, block shape, or particle shape, so as to reduce the occupied volume, thereby facilitating storing the towel material units. The towel material units may be mass produced directly through the factory, thereby greatly decreasing the cost of fabrication. Especially, the wet towel manufacturing apparatus does not have the cutting blade set and the twisting set that are most easily worn out, thereby greatly reducing the possibility of failure. In addition, the towel material units in accordance with the present invention derived from cotton starch, wood starch etc. made of a natural fiber or synthetic fiber may be made to have a strip shape, block shape, or particle shape with a smaller compact volume by a drying, compressing or evacuating manner. Thus, before the towel material units absorb the liquid, they have a smaller volume and occupy a smaller space, thereby facilitating the storage. Further, the towel material units derived from cotton starch, wood starch etc. made of a natural fiber or synthetic fiber may be made to have a strip shape, block shape, or particle shape with a smaller compact volume by a drying, compressing or evacuating manner, so that when the towel material units are used as wet towel, they may absorb the liquid to be expanded instantaneously, thereby forming the wet towel.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A manufacturing apparatus for a wet towel, comprising:

a housing, having a chamber and an object outlet, and provided with a control member;

a storage box, placed in the chamber of the housing for accommodating discrete, rolled towel units so that the discrete, rolled towel units may be supplied outward through an outlet;

a control wheel member adapted to control the outlet of the storage box, for dispending the discrete, rolled towel units drawn out from the storage box;

a liquid supply member, for ejecting liquid from a nozzle, so that the discrete, rolled towel units may absorb the liquid; and an output member, for supplying the discrete, rolled towel material units that have absorbed the liquid through the article outlet of the housing.

2. The manufacturing apparatus of a wet towel as claimed in claim 1, wherein the liquid conducted from the liquid supply member is introduced through a hearing member, so that the ejected liquid is heated.

3. The manufacturing apparatus of a wet towel as claimed in claim 1, wherein the liquid conducted from the liquid supply member is introduced through a cooling member, so that the ejected liquid is cooled.

4. The manufacturing apparatus for a wet towel as claimed in claim 1, further comprising an auxiliary nozzle for adding other liquid.

5. The manufacturing apparatus for a wet towel as claimed in claim 1, wherein the storage box accommodates discrete, rolled towel units so that the manufacturing apparatus is without a cutting device for the towel units.

6. A manufacturing apparatus for a wet towel, comprising:

a housing, having a chamber and an object outlet, and provided with a control member;

a storage box, placed in the chamber of the housing for accommodating discrete, rolled towel units, so that the discrete, rolled towel units may be supplied outward through an outlet;

a control wheel member adapted to control the outlet of the storage box, for dispending the discrete, rolled towel units drawn out from the storage box to a tank; and a liquid supply member, for ejecting liquid from a nozzle, so that the discrete, rolled towel units placed in the storage tank may absorb the liquid.

7. The manufacturing apparatus of a wet towel as claimed in claim 6, wherein the liquid conducted from the liquid supply member is introduced through a heating member, so that the ejected liquid is heated.

8. The manufacturing apparatus of a wet towel as claimed in claim 6, wherein the liquid conducted from the liquid supply member is introduced through a cooling member, so that the ejected liquid is cooled.

9. The manufacturing apparatus for a wet towel as claimed in claim 6, wherein the storage tank is the article outlet of the housing.

10. The manufacturing apparatus for a wet towel as claimed in claim 6, further comprising an auxiliary nozzle for adding other liquid.

11. The manufacturing apparatus for a wet towel as claimed in claim 6, wherein the storage box accommodates discrete, rolled towel units so that the manufacturing apparatus is without a cutting device for the towel units.

* * * * *